US008984816B2

(12) United States Patent
Loughren et al.

(10) Patent No.: US 8,984,816 B2
(45) Date of Patent: Mar. 24, 2015

(54) GUTTER AND FASCIA COVER SYSTEM

(71) Applicants: Mark William Loughren, Cedar Rapids, IA (US); Robert William Peck, Cedar Rapids, IA (US); John S. Boardman, Iowa City, IA (US)

(72) Inventors: Mark William Loughren, Cedar Rapids, IA (US); Robert William Peck, Cedar Rapids, IA (US); John S. Boardman, Iowa City, IA (US)

(73) Assignee: Marpea, Inc., Cedar Rapids, IA (US)

( * ) Notice: Subject to any disclaimer, the term of this patent is extended or adjusted under 35 U.S.C. 154(b) by 0 days.

(21) Appl. No.: 14/048,826

(22) Filed: Oct. 8, 2013

(65) Prior Publication Data

US 2014/0033618 A1 Feb. 6, 2014

Related U.S. Application Data

(63) Continuation of application No. 12/546,317, filed on Aug. 24, 2009, now Pat. No. 8,549,791.

(60) Provisional application No. 61/091,565, filed on Aug. 25, 2008.

(51) Int. Cl.

| | |
|---|---|
| ***E04D 13/00*** | (2006.01) |
| ***E04D 13/076*** | (2006.01) |
| ***E04D 13/158*** | (2006.01) |

(52) U.S. Cl.

CPC ..... *E04D 13/076* (2013.01); *E04D 13/158* (2013.01)

USPC ..... 52/13; 52/11

(58) Field of Classification Search

CPC .. E04D 13/076; E04D 13/0725; E04D 13/158

USPC ..... 52/11–14, 94, 96, 97

See application file for complete search history.

(56) References Cited

U.S. PATENT DOCUMENTS

| | | | | |
|---|---|---|---|---|
| 891,405 | A | | 6/1908 | Cassens |
| 3,404,495 | A | * | 10/1968 | Simpson, Jr. ..... 52/58 |
| 3,550,381 | A | | 12/1970 | South |
| 3,826,048 | A | | 7/1974 | Merkin et al. |
| 4,067,152 | A | * | 1/1978 | Wolma ..... 52/60 |
| 4,553,356 | A | | 11/1985 | Pepper |
| 4,713,915 | A | | 12/1987 | Sweers |
| 4,912,888 | A | | 4/1990 | Martin |
| 4,964,247 | A | | 10/1990 | Spica |
| 4,970,832 | A | * | 11/1990 | van Herpen ..... 52/60 |
| 5,537,785 | A | | 7/1996 | Zaccagni |
| 5,797,220 | A | | 8/1998 | Zaccagni |
| 5,862,631 | A | | 1/1999 | Attaway et al. |
| 5,960,591 | A | | 10/1999 | Schluter |
| 6,701,674 | B1 | | 3/2004 | Albracht |
| 7,117,643 | B2 | | 10/2006 | Brown |
| 7,347,027 | B2 | | 3/2008 | McDonald et al. |
| 7,958,677 | B2 | | 6/2011 | Gramling |
| 2001/0009083 | A1 | | 7/2001 | Sullivan |
| 2005/0193639 | A1 | | 9/2005 | Knudson et al. |
| 2008/0289263 | A1 | | 11/2008 | Brochu |

* cited by examiner

*Primary Examiner* — Jeanette E Chapman
*Assistant Examiner* — Daniel Kenny
(74) *Attorney, Agent, or Firm* — Richards Patent Law P.C.

(57) ABSTRACT

An improved gutter system which utilizes an anchored roof segment. The roof segment allows the attachment of a gutter body or a fascia cover via a ball and socket type joint. In order to make the system more aesthetically pleasing, a decorative molding of any color or shape may be attached to the front wall of the gutter body or the fascia cover. Preferably the decorative member resembles a crown molding commonly used in the construction industry; however, an infinite number of profiles are possible and only depend on the designer of the decorative member.

11 Claims, 11 Drawing Sheets

GUTTER AND FASCIA COVER SYSTEM

CROSS-REFERENCE TO RELATED APPLICATION

The present application claims priority from, and the benefit of the filing date of, U.S. Provisional Patent Application Ser. No. 61/091,565.

TECHNICAL FIELD

The invention relates to a rain gutter system with multiple parts with the ability to snap together to form a complete roof edge and gutter assembly or roof edge and fascia assembly.

BACKGROUND

Gutter systems have been the principal means by which water and small debris suspended in the water is carried off the roof of a building or other similar structures. The water runs off the slanted portion of a roof and typically enters a narrow trough which horizontally spans the edge of the roof. The trough, commonly known as a gutter, collects the water and is positioned such that the water is diverted toward one end of the gutter.

Downspouts are typically attached to the gutters at the end where the water is diverted. The downspouts are perpendicular to the gutters and usually reach from the bottom wall of the gutter to the ground. Water flows down the downspouts and flows out an open end near ground level. The water may be further diverted which allows a builder to strategically redirect rain water away from the foundation of a building.

Rain gutters may be constructed of a variety of materials including but not limited to galvanized steel, painted steel, copper, painted aluminum, PVC (and other plastics), concrete, stone, and wood. The material chosen is dependent on the function of the structure as well as the supporting members associated with the gutter system.

In addition to the actual gutter and downspout, several improvements have been made to gutter systems over the years. One of the most widely used improvements is the gutter guard. The guard overlays the open top side of the gutter and is a screen or shield. The screen prevents leaves and other debris from entering the trough shaped interior of the gutter. Certain gutter guards are incorporated into a complete gutter system such as those disclosed in U.S. Pat. No. 6,182,399 while others allow existing gutters to be fitted with guards such as those disclosed in U.S. Patent Publication 2002/0069594.

The improvements as related to gutter guards have improved the functionality of gutter systems, specifically in preventing larger debris from entering the trough of the gutter system and clogging of the downspouts. The need for supporting a heavier, more durable, and more aesthetically pleasing gutter system is still needed in the art. The present invention allows such improvements.

SUMMARY OF THE INVENTION

The present invention utilizes a roof segment to anchor a rain gutter system with a snap on decorative molding. In the alternative, the roof segment can be used to anchor a fascia cover system and a similar snap on decorative molding. The roof segment comprises a substantially planar surface that may be attached to a standard roof of a home or other structure. The roof segment is attached via nails or screws and a roof edge is able to accommodate roofs with different pitches.

The roof segment contains a semicircular extension which forms an open "C-like" configuration on the underside of the structure.

A gutter body contains a front wall, a back wall and a bottom. The back wall comprises a circular extension complementary to the "C-like" structure of the roof segment. The circular extension may be slid within the "C-like" structure and the roof piece then supports the weight of the gutter body and maintains the gutter body in place.

Other structures located on the back wall assist in the positioning of the gutter system and maintaining the system on the structure building. One of these structures is an integral soffit channel capable of receiving a standard soffit projecting from a house or similar structure. In addition to the soffit channel, the outer surface of the back wall contains a number of projecting teeth which engage the fascia of a house. The teeth also serve as a means for visually aligning the gutter body; however, the teeth primarily add overall strength to the gutter body.

The front wall of the gutter body comprises a top edging and a bottom edging designed to connect the decorative molding piece. The decorative molding contains grooves complementary to the top and bottom edging such that the molding may be snapped into place. Once snapped into place the molding is maintained in position. Additionally the outer surface of the front wall may contain an alignment tongue to assist in aligning separate gutter systems.

A gutter guard spanning from the top of the front wall to the upper portion of the back wall may be attached to the gutter system. The gutter guard comprises a bent edge which is received in a slot located on the inner surface of the back wall. The second edge of the guard rests upon the upper surface of the decorative molding. Once in place the guard keeps debris out of the gutter portion of the system and prevents clogging.

In addition to the gutter guard, the system may also contain an alternate gutter bottom which may be attached to the system. The alternate gutter bottom effectively reduces the depth of the system while allowing the different placements of downspouts.

Similar to the gutter system a second embodiment of the invention contains a roof piece and a decorative molding. Instead of containing a gutter body, the second embodiment has a fascia cover. The fascia cover contains the same basic structures of the back wall of the gutter system. The decorative molding may therefore be snapped into place on the fascia cover.

BRIEF DESCRIPTION OF THE DRAWINGS

These and other features and advantages of the present invention will be better understood by reading the following detailed description, taken together with the drawings wherein.

DETAILED DESCRIPTION

Figure 1:
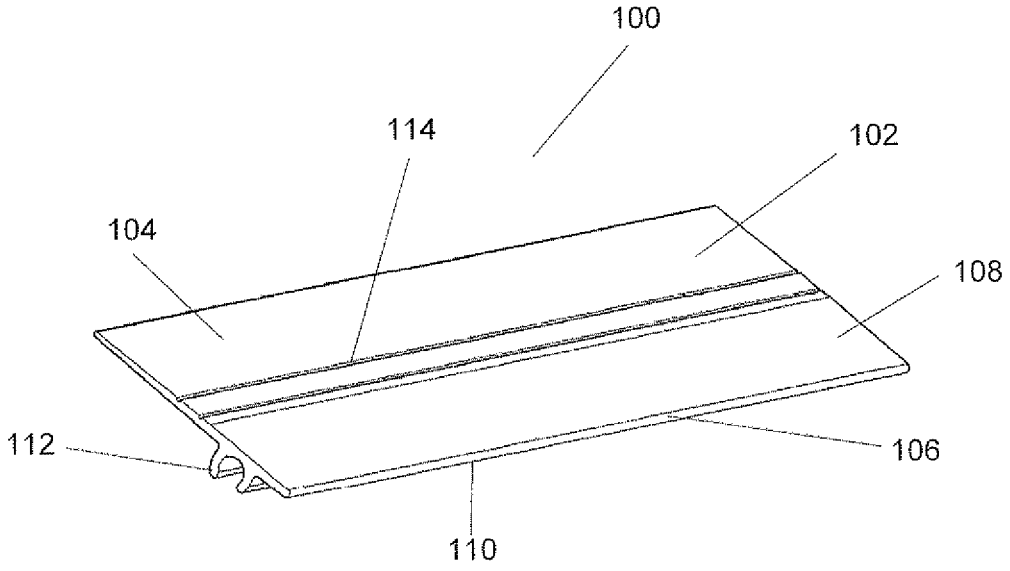
FIG. 1 is a front perspective of the roof segment.

Now referring to the drawings, FIG. 1 depicts a roof segment 100. The roof segment comprises a planar surface 102 having a top edge 104 and a drip edge 106. The top edge 104 is preferably tapered at the top, which allows a better transition to roof shingles (not shown). The planar surface 102 further comprises a first surface 108 and a second surface 110. The second surface 110 contains a socket element 112 depending from the second surface 110. In the preferred embodiment, the socket element 112 is C-shaped. The first surface 108 contains at least one screw starter groove 114 which aids in the attachment of the roof segment 100 to the edge of the roof of a typical house or other structure requiring a gutter system.

Figure 2:
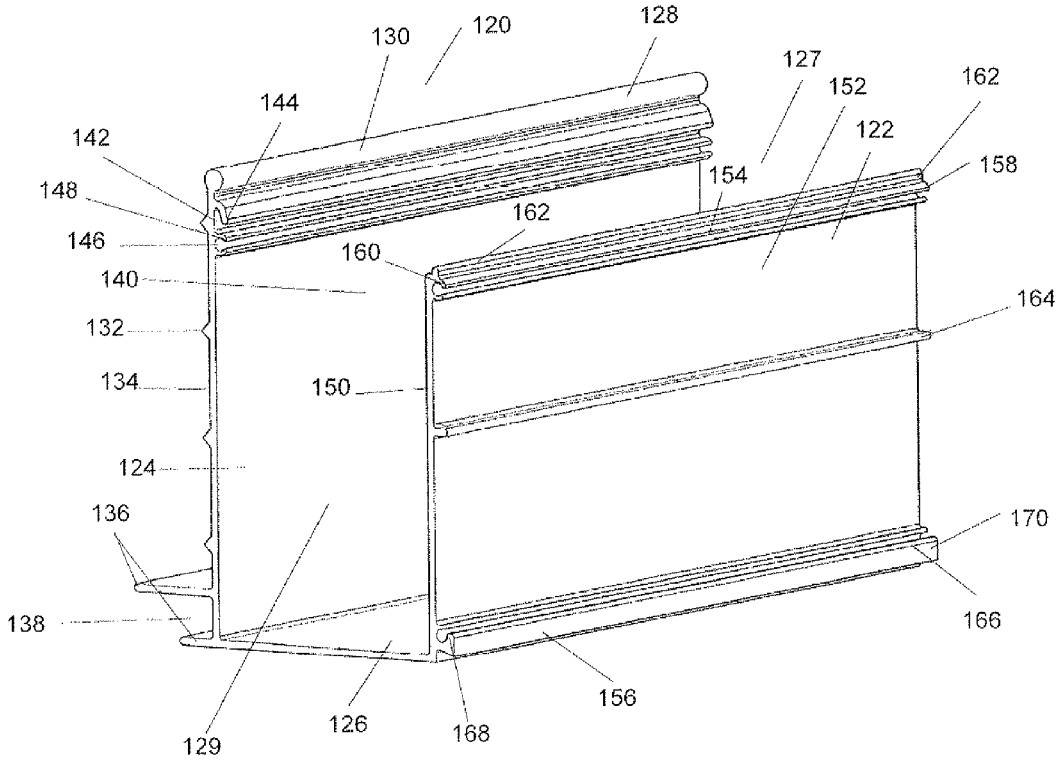
FIG. 2 is a front perspective of the gutter body.

Now referring to FIG. 2, a gutter body 120 is detailed. The gutter body 120 comprises the primary structures of a front wall 122, a back wall 124, and a floor 126. The walls 122, 124 and floor 126 cooperate to form the gutter body 120 having an open top 127 and two open sides 129. The back wall 124 further comprises an upper portion 128. The upper portion 128 comprises a ball joint 130. The back wall 128 also contains alignment teeth 132. An outer surface 134 of the back wall 128 has two extensions 136 protruding at a substantial perpendicular to the back wall 128. Together the extensions 136 form a soffit channel 138. The back wall 128 also comprises an inner surface 140 which further comprises a gutter guard cavity 142 defined by a guard retainer tab 144 which extends from the inner surface 140. Although a variety of angles may be adequate, the preferred embodiment has an angle between thirty and 60 degrees. The inner surface 140 also contain a first screw boss cavity 146 defined by a socket-like extension 148 extending from the inner surface 140. The cavity 146 is preferably round and able to receive a standard screw.

Again referring to FIG. 2, the front wall 122 comprises an inner surface 150 and an outer surface 152. The outer surface 152 has a top 154 and a bottom 156. The top 154 comprises an upper screw boss cavity 158 defined by a socket-like extension 160 extending from the outer surface 152. Preferably the socket-like extension 160 comprises an upper decorative member retainer tab 162. The outer surface 152 further comprises an alignment tab 164 located between the top 154 and bottom 156, preferably at midway down the outer surface 152. The bottom comprises a lower screw boss cavity 166 defined by a second socket-like extension 168 extending from the outer surface 152. The socket-like extension 168 comprises a lower decorative member retainer tab 170 slightly depending from the extension 168. The lower decorative member retainer tab 170 may instead extend from the outer surface 152 preferably near the bottom 156.

Figure 3:
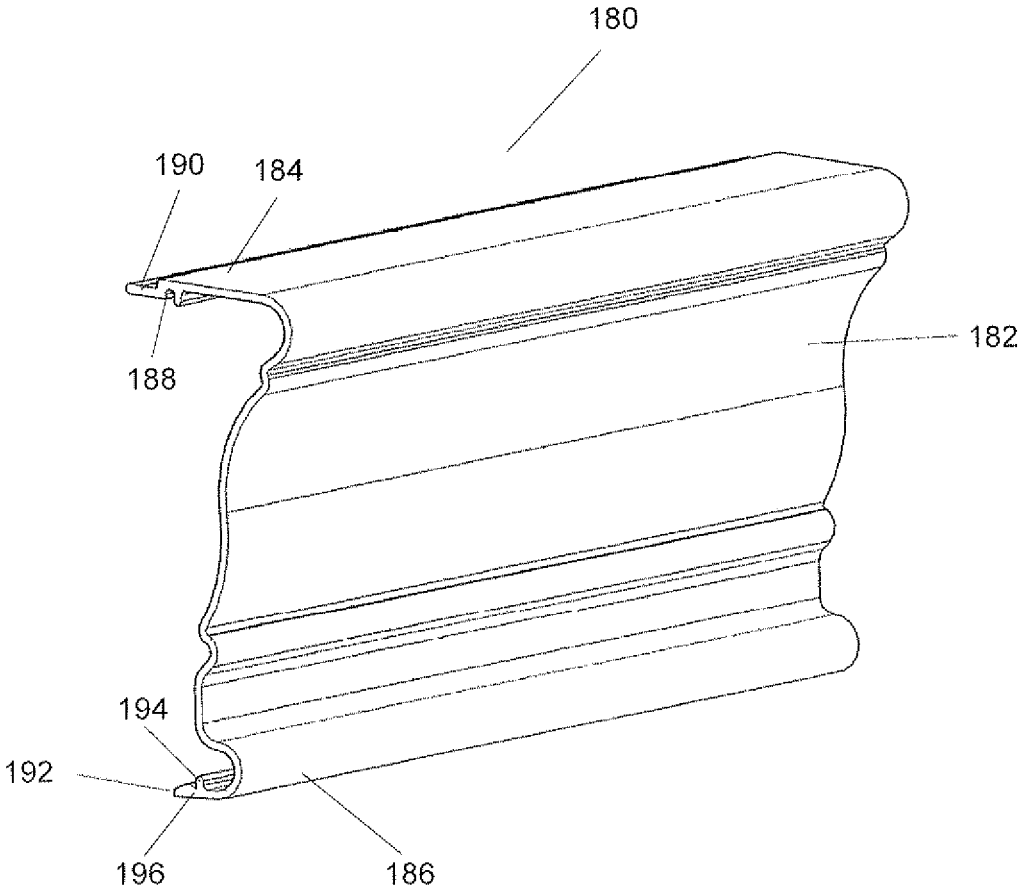
FIG. 3 is a front perspective of the decorative member.

Now referring to FIG. 3, a decorative member 180 comprises a face 182, a first end 184 and a second end 186. The face 182 may be an infinite number of shapes but preferably resembles the shape of crown molding. In addition to the infinite number of shapes, the face may be painted in an infinite number of colors. The first end 184 comprises an upper groove 188. The groove 188 runs the length of the first end 184. The upper groove 188 may be a cavity formed by two projections depending from the first end 184 or from a cavity formed by hollowing out a portion of the first end 184. The preferred embodiment utilizes a combination of the two methods. The first end 184 further comprises a support tab 190 for a gutter guard 200, shown in FIG. 3. The second end comprises an extension 192. The extension 192 contains a projection 194 running the length of the second end 186. The extension 192 further comprises a lower groove 196 formed by the projection 194 and the second end 186.

Figure 4:
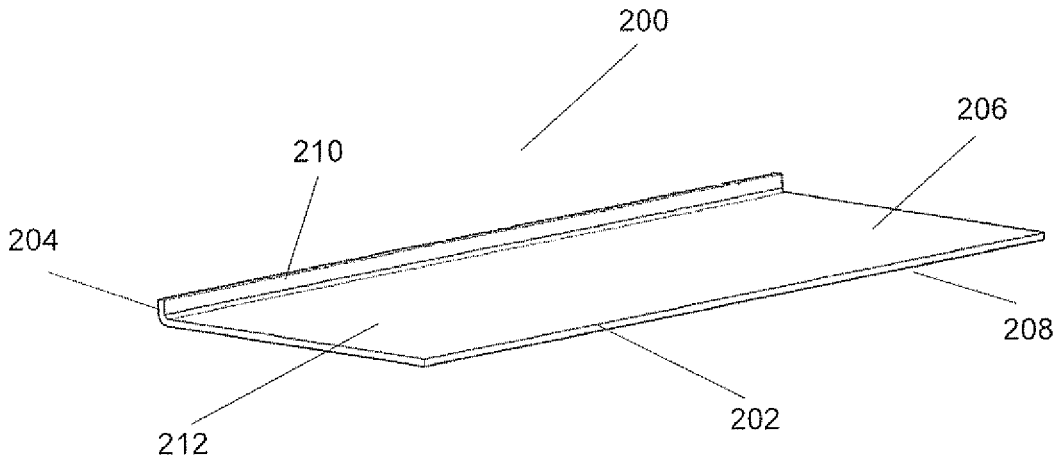
FIG. 4 is a front perspective of the leaf guard.

Now referring to FIG. 4, a gutter guard 200 is depicted. The gutter guard 200 comprises a front side 202 and a back side 204. The gutter guard 200 further comprises an upper surface 206 and a lower surface 208; both surfaces 206 and 208 are preferably perforated to allow liquid to pass through the gutter guard 200 and into the gutter body 120, shown in FIG. 2. The gutter guard 200 is substantially planar except for a bent edge 210 that is substantially perpendicular to a main body 212.

Figure 5:
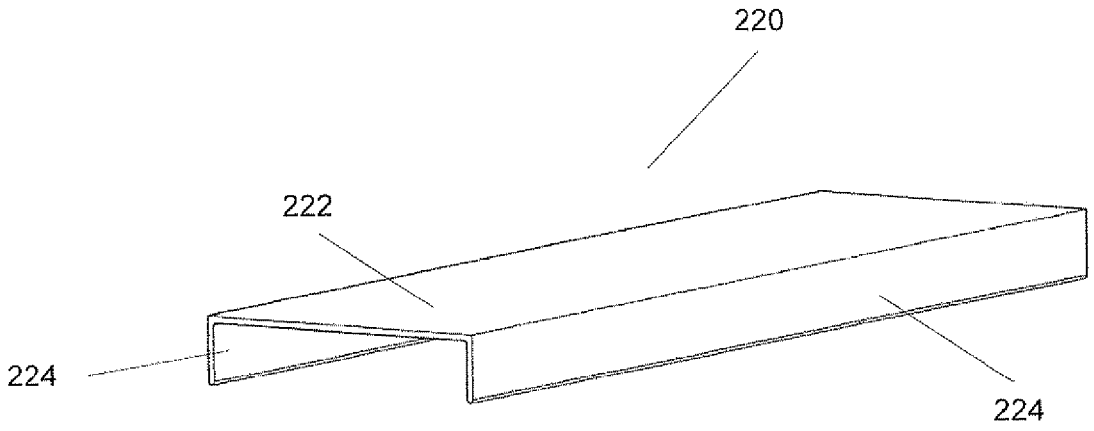
FIG. 5 is a front view of the alternate gutter bottom.

FIG. 5 shows an alternate gutter bottom 220 comprising a substantially planar portion 222 and two depending segments 224. The depending segments 224 are substantially perpendicular to the planar portion 222.

Figure 6:
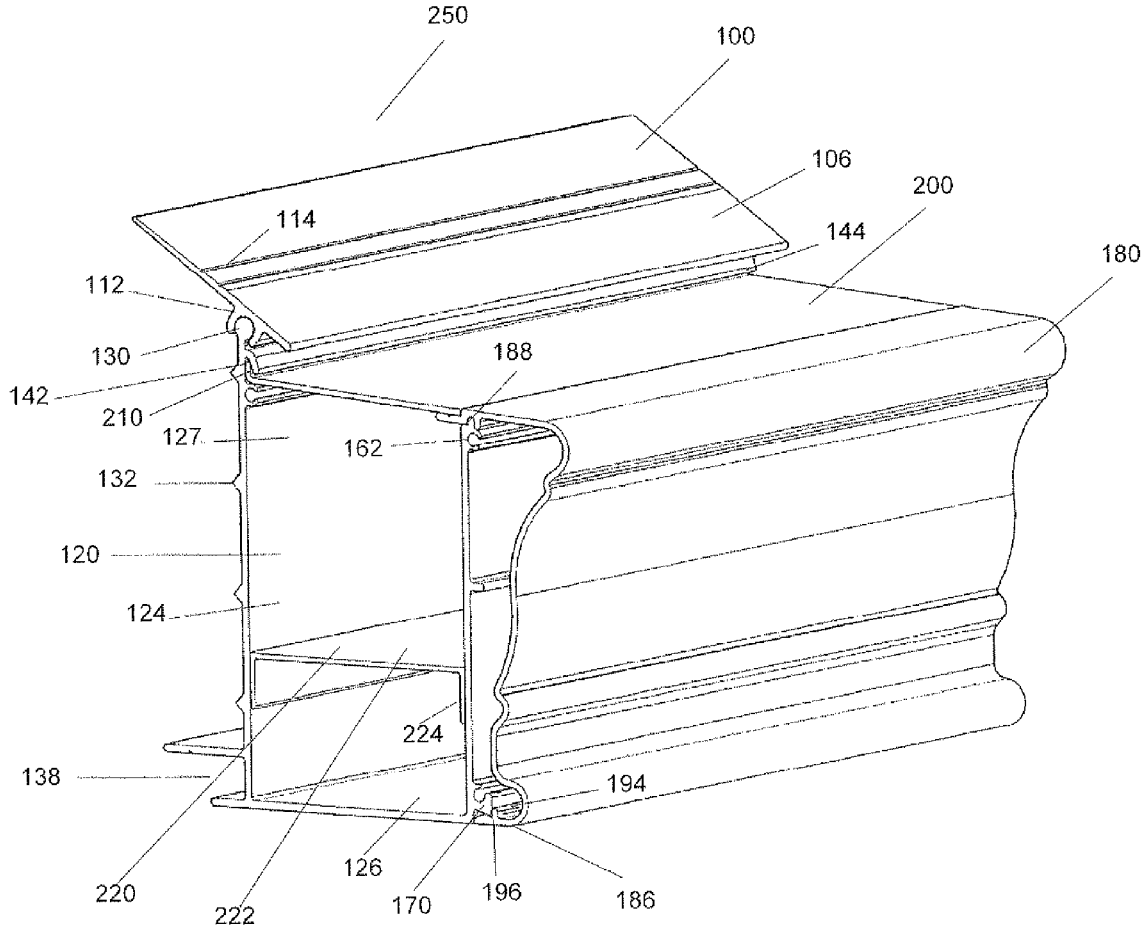
FIG. 6 is a front perspective of the gutter assembly with gutter guard, decorative member and alternate gutter bottom.

Now referring to FIG. 6, the components detailed in FIGS. 1-5 are shown in an assembled gutter system 250. After the roof segment 100 is attached to a standard house roof via screws or nails started in the screw starter groove 114, the gutter body 120 is slid within the socket element 112 of the roof segment 100. The ball joint 130 is fashioned such that it may be received within the socket element 112 and be retained within the socket element 112 even after the gutter system 250 is hung on the roof of a house. The ball joint 130 is able to swivel within the socket element 112 which allows the gutter system 250 to then adjust to different roof pitches ranging from 0:12 to 14:12. The soffit of a house is positioned within the soffit channel 138 further leading to the stability of the gutter system 250 on the roof. Once the system 250 is hung on the roof, the preferred embodiment has the alignment teeth 132 positioned against the subfascia of the house. A drip edge 106 of the roof segment 100 extends slightly over the back wall 124 so water and debris is better directed into the open top 127.

Again referring to FIG. 6, the optional features of the gutter system 250 may be seen attached to the gutter body 120. First, the decorative member 180 is selectively attached to the gutter body 120. The upper decorative member retaining tab 162 engages the upper groove 188 of the decorative member 180. The decorative member 180 is flexible enough such that the second end 186 may be manipulated over the lower decorative member retainer tab 170. The lower decorative member retaining tab 170 is held within the lower groove 196 and abuts the projection 194. The decorative member 180 is then secured on both ends and attaches in a snap-on type fashion.

Again referring to FIG. 6, the gutter guard 200 is attached by sliding the bent edge 210 within the gutter guard cavity 142. The front side 202 of the gutter guard 200 then may rest upon the support tab 190 of the decorative member 180. Once the gutter guard 200 is secured on both sides it is held in place by the guard retainer tab 144 and the support tab 190. To further maintain the gutter guard 200 in place, a screw may be utilized to secure the support tab 190 to the front side 202 of the gutter guard 200.

The last optional piece, the alternate gutter bottom 220 is shown in FIG. 6 attached to the gutter body 120. The alternate gutter bottom 220 is positioned in the gutter body 120 such that the planar surface 222 is substantially parallel with the floor 126 and the depending segments 224 are abutting and in parallel with the back wall 124 and the front wall 122. The alternate gutter bottom 220 may be used in the gutter system 250 selectively when a raised bottom is necessary for a variety of reasons. The alternate gutter bottom may be secured by utilizing standard screws which go through the depending segments 224 and the walls 122, 124.

Figure 7:
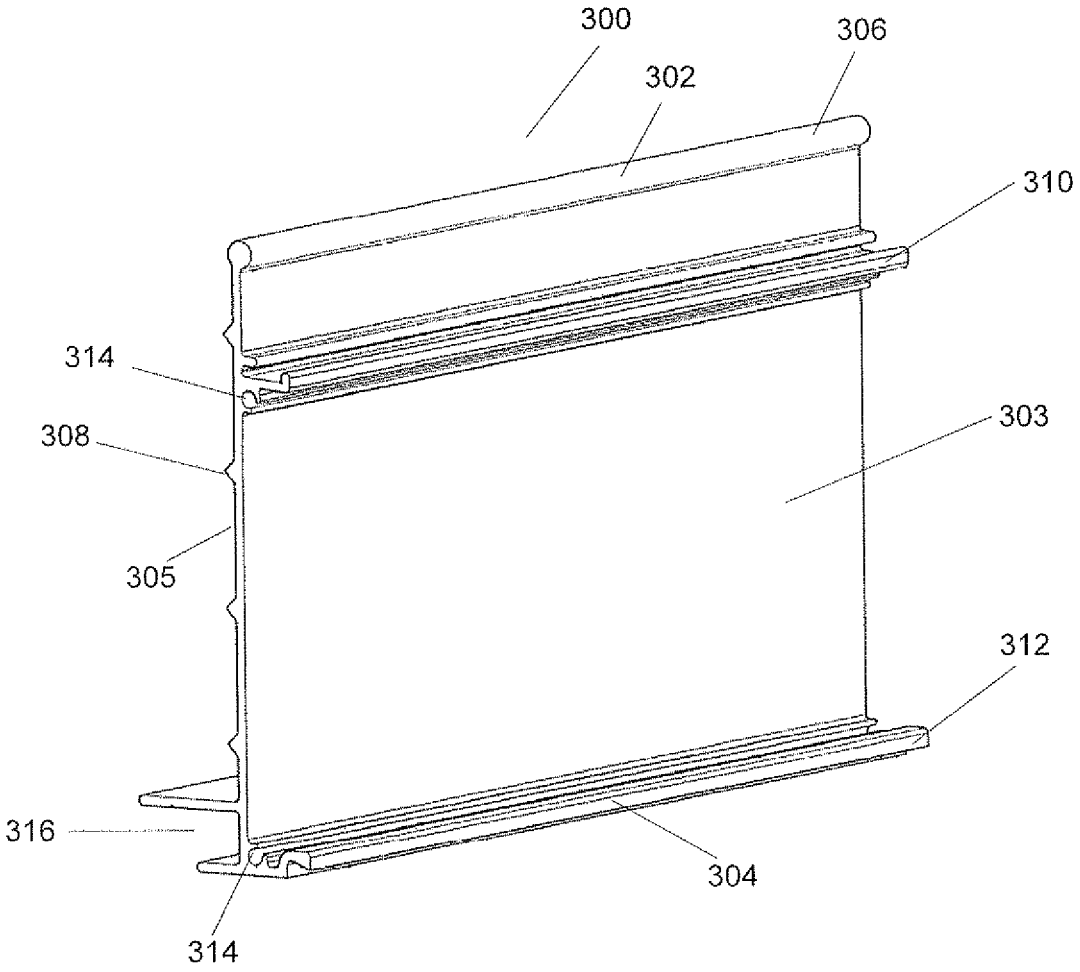
FIG. 7 is a front perspective of the fascia cover.

FIG. 7 depicts a fascia cover 300 comprising a first end 302, a second end 304, a first surface 303 and a second surface 305. The second surface 305 of the fascia cover 300 has many of the same structure as the black wall 124 of the gutter body 120 as depicted in FIG. 2. The fascia cover 300 further comprises a ball joint 306, alignment teeth 308 and a soffit channel 316. The first surface 303 comprises structures similar to the front wall 122 of the gutter body 120 as depicted in FIG. 2. The first surface 303 specifically comprises an upper retainer tab 310 and a lower retainer tab 312 which both extend from the first surface 303. The first surface 303 comprises two screw bosses 314.

Figure 8:
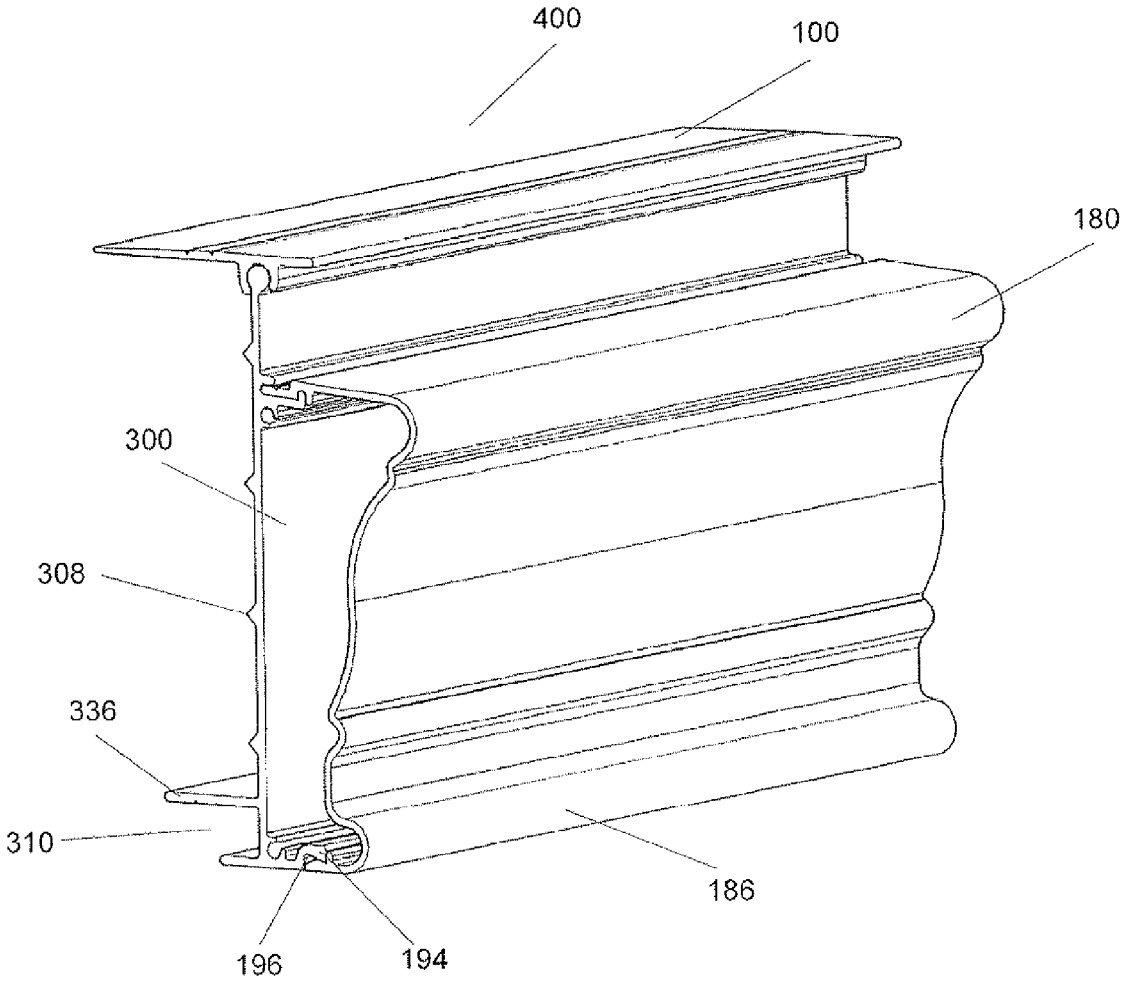
FIG. 8 is a front perspective of the fascia cover system with the decorative member.

Now referring to FIG. 8 fascia cover system 400 is shown. Also referring to FIG. 1 and FIG. 3 and FIG. 7, the fascia cover system is comprised of the roof segment 100, the decorative member 180 and the fascia cover 300. After the roof segment 100 is attached to a standard house roof via screws or nails started in the screw starter groove 114, the ball joint 306 is slid within the socket element 112 of the roof segment 100. The ball joint 306 is fashioned such that it may be received within the socket element 112 and be retained within the socket element 112 even after the fascia cover system 400 is hung on the roof of a house. The soffit of a house is positioned within the soffit channel 316 further leading to the stability of the fascia cover system 400 on the roof. Once the system 400 is hung on the roof, the preferred embodiment has the alignment teeth 308 positioned against the fascia of the house.

Again referring to FIG. 8, the decorative member 180 is selectively attached to the fascia cover 300. The upper retainer tab 310 engages the upper groove 188 of the decorative member 180. The decorative member 180 is flexible enough such that the second end 186 may be manipulated over the lower retainer tab 312. The lower retainer tab 312 is held within the lower groove 196 and abuts the projection 194 of the decorative member 180. The decorative member 180 is then secured on both ends and attaches in a snap-on type fashion.

Figure 9:
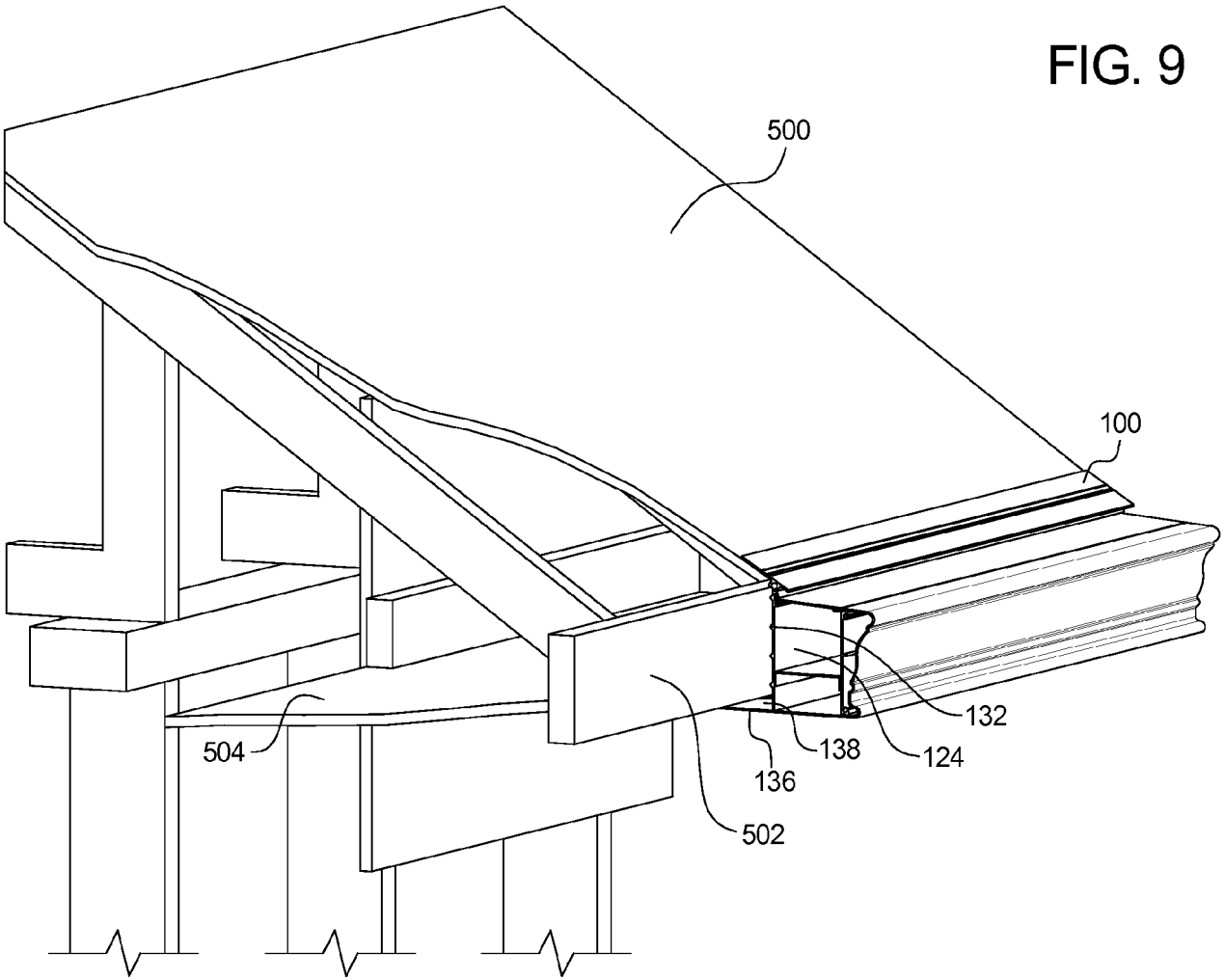
FIG. 9 is a depiction of the gutter system on the roof of a house.

Now having described the gutter assembly 250 and the fascia cover system 400, FIG. 9 demonstrates the gutter assembly on a roof 500. The roof segment 100 may be seen connected to the roof 500. Furthermore, the back wall 124 is depicted abutting fascia 502. The soffit channel 138 is shown engaging soffit 504. The overall strength of the structure provided by the roof segment, the aligning teeth 132 and the extensions 136 allow heavier more durable materials such as steel or extruded aluminum.

Figure 10:
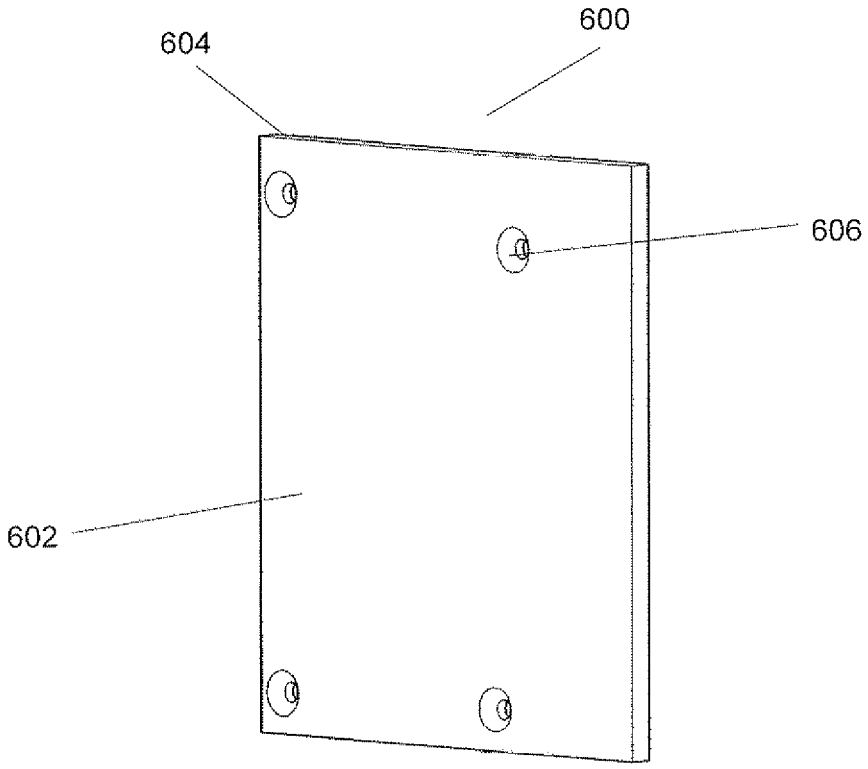
FIG. 10 is a front perspective of the concealed end cap.
Figure 11:
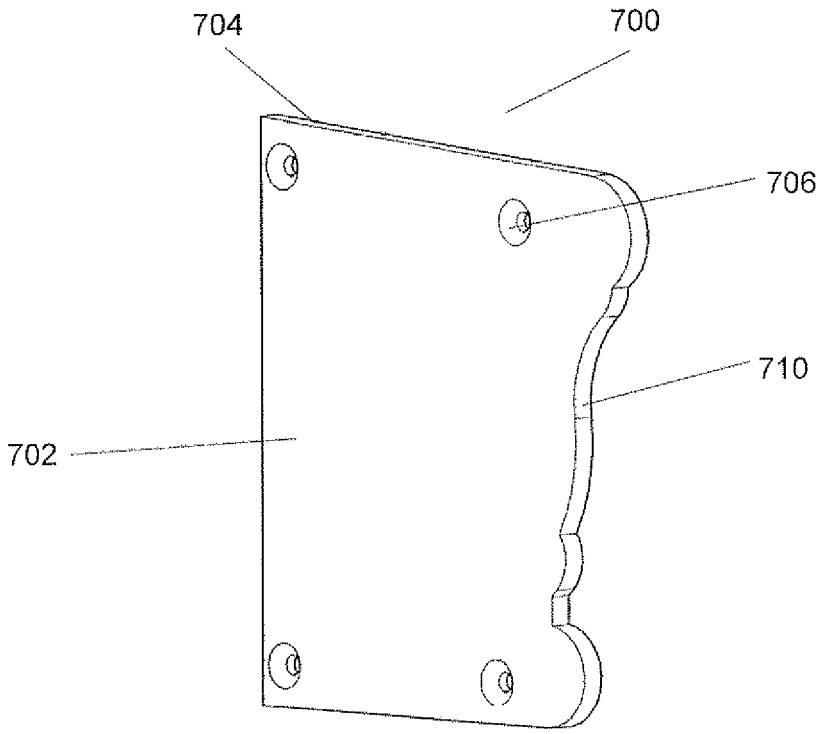
FIG. 11 is a front perspective of the exposed end cap.

Now referring to FIG. 10 and FIG. 11, show a concealed end cap 600 and an exposed end cap 700, respectively. The concealed end cap 600 comprises a first surface 602 and a second surface 604. The preferred embodiment contains four holes 606 which correspond to the screw boss cavities of the gutter body 120 in FIG. 2. The concealed end cap 600 can be attached to the gutter body 120 by use of screws (not shown) which enter the holes 606. The second surface 604 is thus abutting the gutter body 120 shown in FIG. 2. The concealed end cap 600 is typically utilized wherein the end of the gutter body 120 would abut a portion of the house and not be visible to a person on the ground. An exposed end cap 700 is detailed in FIG. 11 and contains similar structures to the concealed end cap 600. The exposed end cap 700 comprises a first surface 702 and a second surface 704. The preferred embodiment contains four holes 706 which correspond to the screw boss cavities of the gutter body 120 in FIG. 2. The exposed end cap 700 can be attached to the gutter body 120 by use of screws (not shown) which enter the holes 606. Depending on which open side 129 of the gutter body 120 of FIG. 2 is being capped by the exposed end cap 700, either the first surface 702 or the second surface 704 will be abutting the gutter body 120. The exposed end cap 700 comprises a decorative edge 710 which can be of any shape. The shape of the decorative edge 710 preferably matches the shape of the face 182 of the decorative member 180 shown in FIG. 3. The exposed end cap 700 is utilized when the end of the gutter body 120 would be visible to a person on the ground.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A decorative system for the gables of a building comprising:

a fascia cover including a first element of a pivot joint along a top edge and a first surface including an upper retainer tab and a lower retainer tab;

a roof segment including a second element of the pivot joint pivotally attached to the first element of the pivot joint to form the pivot joint along a bottom surface of the roof segment; and an ornamental member including a top edge and a bottom edge, wherein the top edge of the ornamental member mates with the upper retainer tab of the fascia cover and the bottom edge of the ornamental member mates with the lower retainer tab of the fascia cover, wherein the first element of the pivot joint along the top edge of the fascia cover includes an approximately circular cylindrical cross-section.

2. The decorative system of claim 1 wherein the fascia cover includes a second surface including one or more teeth.

3. The decorative system of claim 1 wherein the fascia cover includes a second surface including a soffit channel.

4. The decorative system of claim 1 wherein the ornamental member mates with the first surface via a snap-fit connection.

5. A decorative system for the gables of a building comprising:

a roof segment including an upper surface, a lower surface, and a mating extension depending from the lower surface;

a fascia cover including a complementary mating portion, wherein the fascia cover includes a first surface including a lower retainer tab;

a decorative member mated to the first surface in a snap-fit connection with the lower retainer tab, wherein, upon the first surface of the fascia cover mating with the decorative member, a space is maintained between the decorative member and the fascia cover.

6. The decorative system of claim 5 wherein the mating extension includes an approximately C-shaped cross-section and further wherein the complementary mating portion includes an approximately circular cylindrical cross-section that fits within the approximately C-shaped cross-section of the mating extension.

7. The decorative system of claim 5 wherein the fascia cover includes a second surface including one or more teeth.

8. The decorative system of claim 5 wherein the fascia cover includes a second surface including a soffit channel.

9. A decorative system for the gables of a building comprising:

a roof segment including an upper surface, a lower surface, and a mating extension depending from the lower surface;

a fascia cover including a complementary mating portion, wherein the fascia cover includes a first surface including a lower socket-like extension;

a decorative member mated to the front wall in a snap-fit connection with the lower socket-like extension wherein the mating extension includes an approximately C-shaped cross-section and further wherein the complementary mating portion includes an approximately circular cylindrical cross-section that fits within the approximately C-shaped cross-section of the mating extension.

10. The decorative system of claim 9 wherein the fascia cover includes a second surface including one or more teeth.

11. The decorative system of claim 9 wherein the fascia cover includes a second surface including a soffit channel.

* * * * *